US007049552B2

(12) United States Patent
Arntz et al.

(10) Patent No.: US 7,049,552 B2
(45) Date of Patent: May 23, 2006

(54) VENTILATION SYSTEM FOR A COOKING APPLIANCE

(75) Inventors: Timothy J. Arntz, Cleveland, TN (US); William D. Barritt, Cleveland, TN (US); Jeffrey Ensley, Cleveland, TN (US); Dustin L. Hawkins, Cleveland, TN (US)

(73) Assignee: Maytag Corporation, Newton, IA (US)

( * ) Notice: Subject to any disclaimer, the term of this patent is extended or adjusted under 35 U.S.C. 154(b) by 0 days.

(21) Appl. No.: 10/860,027

(22) Filed: Jun. 4, 2004

(65) Prior Publication Data

US 2005/0269311 A1 Dec. 8, 2005

(51) Int. Cl.
*H05B 3/68* (2006.01)
*F24B 5/04* (2006.01)

(52) U.S. Cl. ..... 219/452.12; 126/15 R

(58) Field of Classification Search ..... 219/451.1, 219/452.11, 452.12, 460.1, 461.1, 448.19; 126/39 H, 393, 15 R, 15 A, 21 R, 92 A, 126/76, 77

See application file for complete search history.

(56) References Cited

U.S. PATENT DOCUMENTS 3,624,352 A * 11/1971 Deaton et al. ..... 219/448.17
3,627,986 A 12/1971 Anderson
3,870,862 A * 3/1975 Doner ..... 219/452.12
3,877,457 A * 4/1975 Doner ..... 126/39 R
4,191,875 A * 3/1980 Cunningham ..... 219/623
4,415,788 A * 11/1983 Field ..... 219/623
4,549,052 A 10/1985 Simon
4,551,600 A 11/1985 Miyagawa et al.
4,899,028 A 2/1990 Arai et al.
5,019,682 A 5/1991 Lee
5,149,944 A * 9/1992 Shimomura ..... 219/445.1
5,406,932 A 4/1995 Joseph et al.
5,446,268 A 8/1995 Chen
5,900,175 A * 5/1999 Kicherer et al. ..... 219/453.14
6,097,000 A 8/2000 Frasnetti et al.
6,410,892 B1 * 6/2002 Peschl et al. ..... 219/461.1
6,444,958 B1 9/2002 Campbell
6,600,139 B1 7/2003 Perschl et al.

* cited by examiner

*Primary Examiner*—Sang Paik
(74) *Attorney, Agent, or Firm*—Diederiks & Whitelaw, PLC

(57) ABSTRACT

A cooking appliance includes a frame having a bottom wall for supporting heating elements and a peripheral side portion that extends from and about an outer periphery of the bottom wall so as to define a chassis upon which is arranged a cooktop. The peripheral side portion includes a plurality of openings that lead into the chassis. A control box is mounted in the chassis for housing control elements and associated electronics. The control box includes a plurality of side walls, with at least one of the side walls being provided with a vent which opens into the chassis. A fan is mounted within the chassis wherein, when the fan is activated, a cooling airflow is developed, with a first portion being drawn directly into the chassis, while a second portion first enters the control box housing before being directed into the chassis. A cover can be disposed beneath the chassis to guide and disperse the airflow.

20 Claims, 4 Drawing Sheets

VENTILATION SYSTEM FOR A COOKING APPLIANCE

BACKGROUND OF THE INVENTION

1. Field of the Invention

The present invention pertains to the art of cooking appliances and, more particularly, to a ventilation system for developing an airflow that cools control elements, as well as an internal chassis portion, of a cooktop.

2. Discussion of the Prior Art

In general, smooth-top cooking surfaces are well known in the art and are generally associated with a range or mounted in a countertop. A typical cooktop includes a frame having secured thereto a plurality of heating elements which are covered by a glass-ceramic panel or other type of cooking surface. In addition, the cooktop includes a plurality of control elements, each of which is associated with operating a corresponding heating element mounted to the cooktop. In many cases, the cooktop includes openings that enable cooling air to pass through a top portion of the cooktop to draw away heat generated by the heating elements. The airflow can also be directed by the control elements to protect any associated electronics.

Generally, manufacturers mount the control elements in a separate area of the frame. This arrangement eliminates the need for complicated mounting brackets associated with mounting controls or switches alongside the heating elements on the cooktop. In addition, mounting the control elements remote from the heating elements eliminates, or at least reduces, the need to shield control electronics from heat generated by the heating elements. However, the addition of a separate area dedicated to the controls reduces the overall available surface area of the cooktop. Add to that the need for a cooling air inlet opening, and the available cooking space is considerably reduced.

Based on the above, there exists a need for a ventilation system which will effectively cool control elements, associated electronics and areas around heating elements below an appliance cooktop. More specifically, there exists a need for a ventilation system that employs inlet openings in areas other than top portions of the cooktop to provide additional space for heating elements and other advantages structure of the appliance.

SUMMARY OF THE INVENTION

The present invention is directed to a ventilation system for a cooking appliance. The cooking appliance includes a frame having a bottom wall which supports a plurality of heating elements. The frame further includes a peripheral side portion that extends from and about an outer periphery of the bottom wall so as to define a chassis upon which is arranged a cooktop. In accordance with the invention, the peripheral side portion includes a plurality of openings that allow air to pass into the chassis.

In further accordance with the invention, the cooking appliance includes a control box mounted within the chassis at a position directly adjacent to one of the plurality of openings in the peripheral side portion. Preferably, the control box includes a plurality of side walls that define a housing for electrical components associated with controlling the heating elements of the cooking appliance. At least one of the side walls is provided with a vent or opening that leads into the chassis. A fan is mounted within the chassis to establish a negative pressure in the chassis so as to cause a cooling airflow to pass through both the control box and the chassis. More specifically, a first portion of the airflow is drawn directly into the chassis through the plurality of openings in the peripheral side portion and a second portion of the airflow first enters the control box before being guided into the chassis. The combined airflow then exits the chassis through an opening in the bottom wall.

Additional objects, features and advantages of the present invention will become more readily apparent from the following detailed description of preferred embodiments when taken in conjunction with the drawings wherein like reference numerals refer to corresponding parts in the several views.

DETAILED DESCRIPTION OF THE PREFERRED EMBODIMENTS

Figure 1:
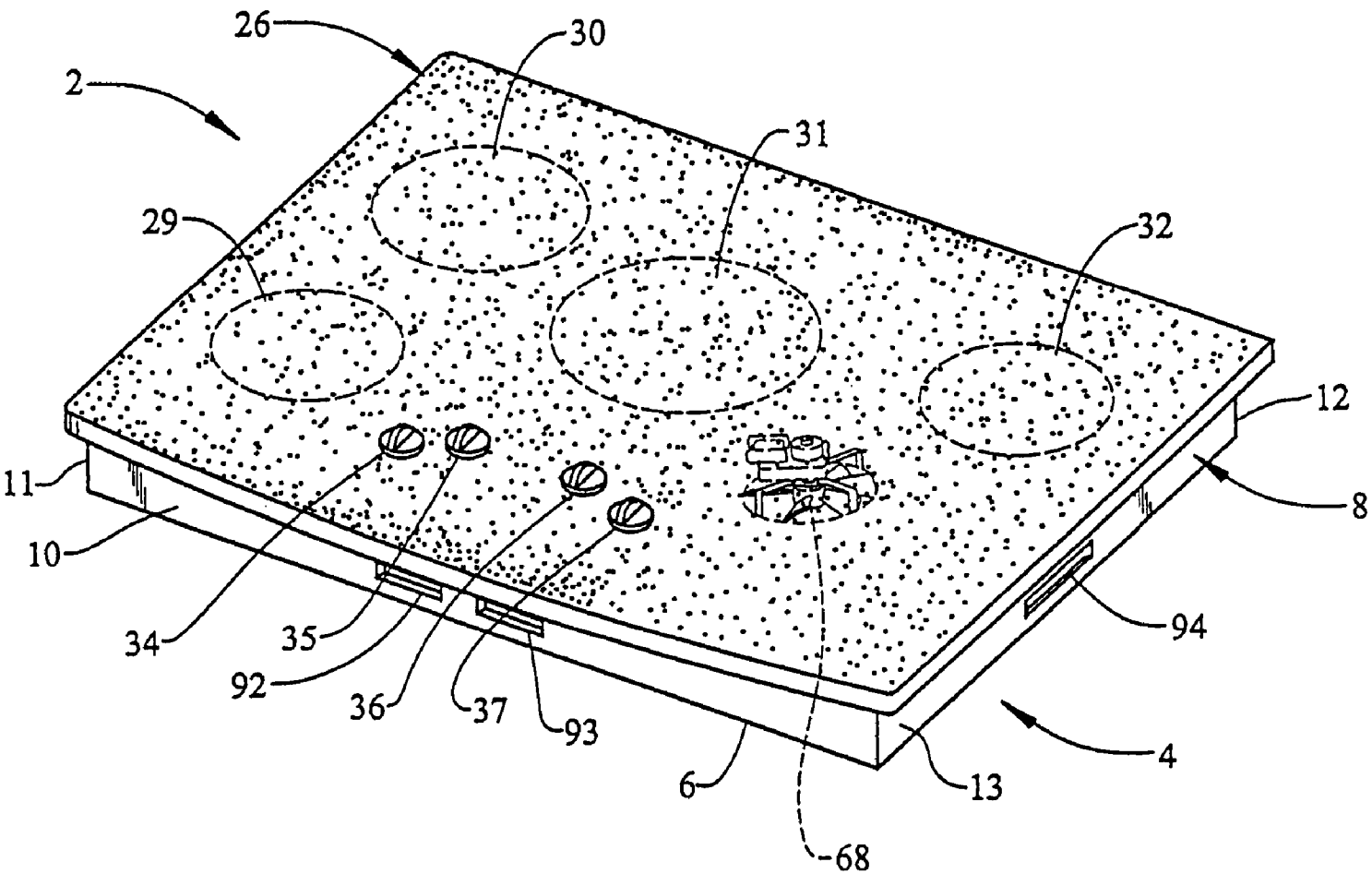
FIG. 1 is a upper right perspective view of a cooktop incorporating a ventilation system constructed in accordance with the present invention.
Figure 2:
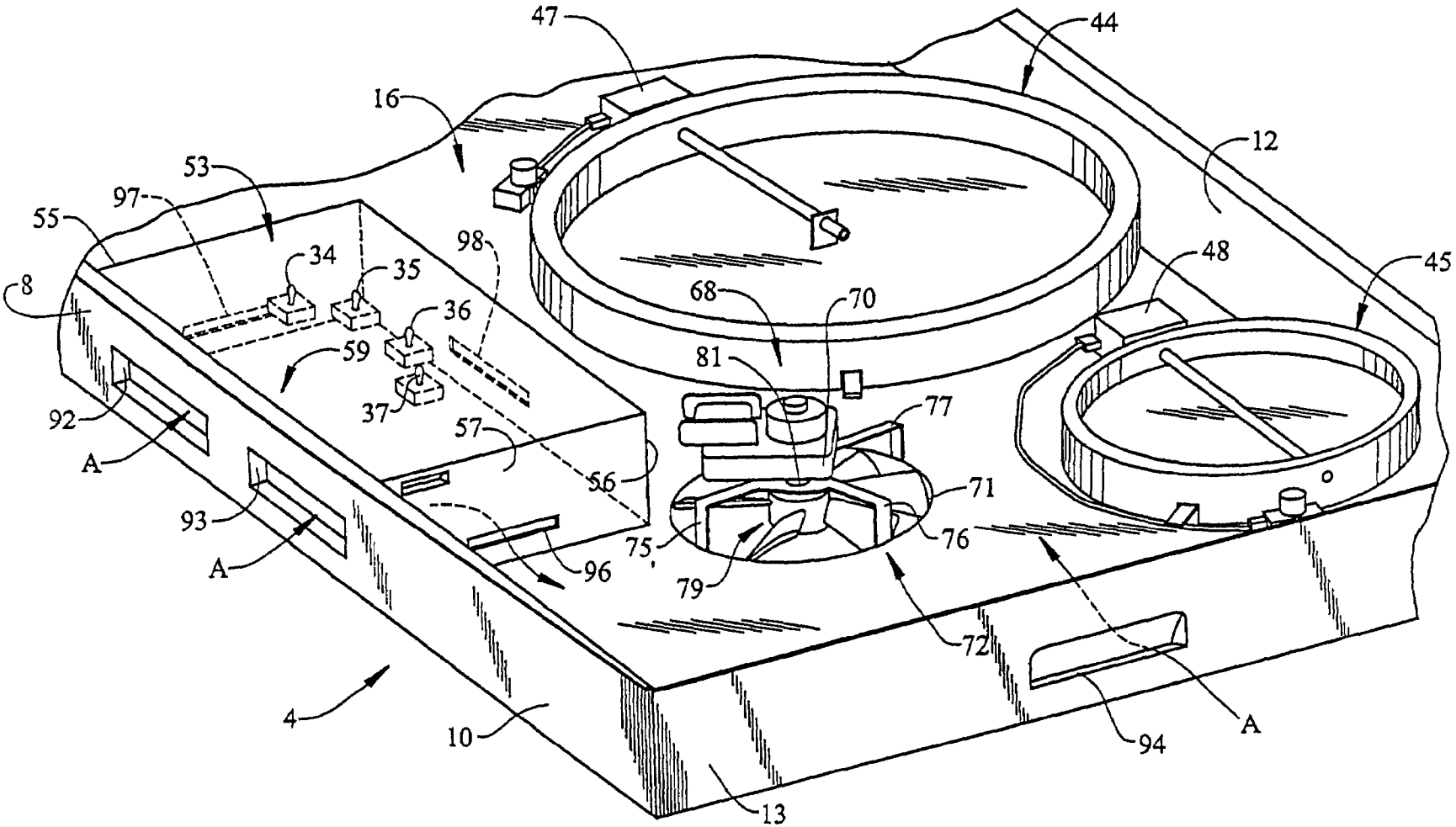
FIG. 2 is a partial, perspective view of the ventilation system arranged in a chassis of the cooktop of FIG. 1.

With initial reference to FIGS. 1 and 2, a cooking appliance constructed in accordance with the present invention is generally shown at 2. Although the actual cooking appliance into which the present invention can be incorporated may vary, the invention is shown in connection with cooking appliance 2 depicted as a cooktop model that is adapted to be arranged in a kitchen countertop. However, it should be understood that the present invention is not limited to this particular model type and could also be incorporated into various oven range configurations, e.g., both free-standing and slide-in ranges. In the embodiment shown, cooking appliance 2 includes a frame section 4 having a bottom wall 6 and a peripheral side portion 8. As shown, peripheral side portion 8 extends substantially perpendicularly upward from bottom wall 6 and is constituted by a plurality of side walls 10–13. In accordance with the invention, bottom wall 6 and peripheral side portion 8 combine to establish a chassis 16 for cooking appliance 2.

Cooking appliance 2 is also provided with a cooking surface 26 which, in the embodiment shown, is constituted by a smooth glass/ceramic cooktop. Cooking surface 26 is provided with a plurality of cooking zones 29–32 which are selectively operated by a corresponding plurality of control elements or knobs 34–37. Although not shown in the embodiment depicted, cooking appliance 2 could be provided with a downdraft fan unit arranged on cooking surface 26 in order to draw away smoke or other byproducts that may be generated during cooking upon cooking surface 26.

As best shown in FIG. 2, arranged within chassis 16 are a plurality of mounting elements, such as those indicated generally at 44 and 45, which are adapted to receive, for example, a heating element (not shown), such as a sheathed, electric heating element. Although not shown, it should be understood that each cooking zone 29–32 has a corresponding mounting element. In any event, in order to regulate the temperature of each cooking zone 29–32, each mounting element 44, 45 includes a corresponding thermostat 47, 48. In addition, arranged within chassis 16 is a control box 53. In the embodiment shown, control box 53 extends lengthwise along side wall 10 and includes a plurality of side walls 55–57 that collectively define a housing 59. Arranged within housing 59 are various electronics and switches (not labeled or fully depicted) that are associated with control elements 34–37. Due to the heat generated by operation of cooking appliance 2, it is desired to ventilate chassis 16 and housing 59 in order to protect the various electronic components arranged therein.

In accordance with the most preferred form of the invention, shown mounted within a corner portion of chassis 16 is a blower assembly 68 that, when operated, establishes a negative pressure in chassis 16 in order to create a cooling airflow through chassis 16. More specifically, blower assembly 68 is provided with a motor 70 that is suspended above an opening 71 in bottom wall 6 by a bracket 72. As shown, bracket 72 includes a plurality of supports or legs 75–77 which are fastened about opening 71. Blower assembly 68 further includes a fan 79 that is operatively connected to motor 70 through a shaft 81. With this construction, activating motor 70 causes fan 79 to rotate for drawing a cooling airflow into chassis 16, with the airflow being expelled through opening 71 and away from cooking appliance 2 as discussed more fully below.

In further accordance with the most preferred form of the invention, the airflow generated by blower assembly 68 is drawn into chassis 16 through a plurality of openings 92–94 arranged in side walls 10 and 13 of peripheral side portion 8. Of course, additional vents (not shown) could also be provided in side walls 11 and 12. In any event, by providing openings 92–94 in peripheral side portion 8, the need to provide openings in, for example, cooking surface 26, becomes unnecessary. Thus, additional space can be allocated for additional cooking zones or other advantageous features associated with cooking appliance 2. In any event, in addition to providing openings 92–94 in peripheral side portion 8, at least one vent or opening 96 is provided in side wall 57 of housing 59. Additional vents 96 and 98 are preferably provided in side walls 55 and 56. With this construction, the operation of blower assembly 68 establishes an airflow that is drawn through openings 92–94 and into chassis 16. More importantly, the airflow that is guided into openings 92 and 93 initially enters housing 59 prior to exiting through one or more of vents 96–98 into chassis 16. In this manner, both the electronics arranged within housing 59, as well as the other components within chassis 16, will have a forced cooling airflow passing thereover during operation of cooking appliance 2.

Figure 3:
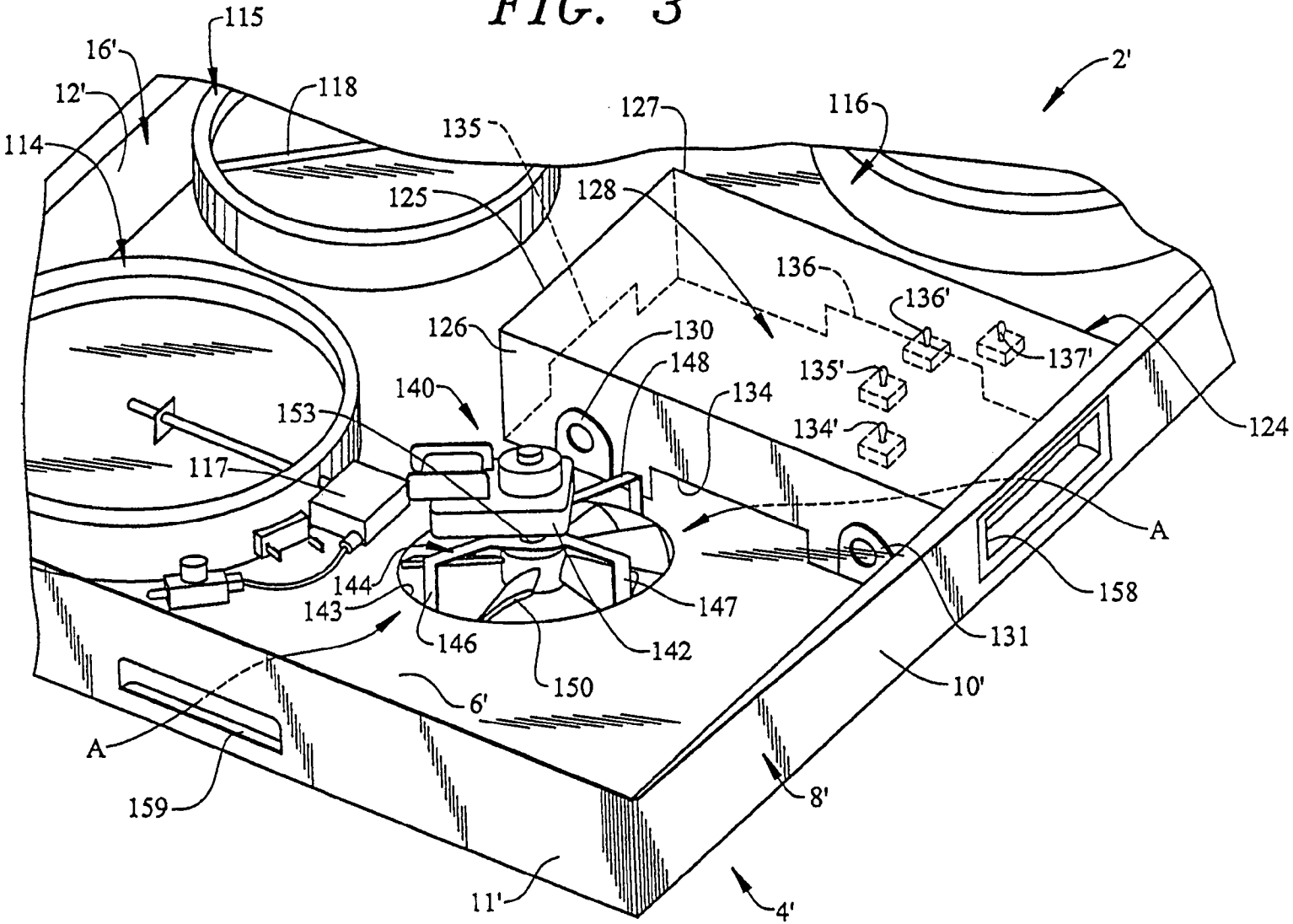
FIG. 3 is a partial, perspective view of the ventilation system arranged in a chassis of a cooktop constructed in accordance with a second embodiment of the present invention.

Reference will now be made to FIG. 3 in describing a ventilation system constructed in accordance with a second embodiment of the present invention. As shown, cooking appliance 2' is provided with a frame 4' having a bottom wall 6' and a peripheral side portion 8'. In a manner analogous to that set forth above, peripheral side portion 8' is constituted by a plurality of side walls, such as indicated at 10'–12', that collectively define a chassis 16'. In accordance with the embodiment shown, arranged within chassis 16' are a plurality of mounting elements 114–116, each having a corresponding thermostat, such as indicated at 117 and 118. Additionally, a control box 124, having a plurality of side walls 125–127 defining a housing 128, extends across frame 4'. That is, in contrast to the first embodiment wherein control box 53 extends lengthwise along side wall 10, control box 104 extends widthwise from side wall 10' toward side wall 12' in the FIG. 3 embodiment and is secured to bottom wall 6' through a plurality of mounting ears, such as indicated at 130 and 131, projecting from bottom wall 6'. In addition, side walls 124–126 include various cut-outs which define a plurality of vents 134–136 that provide a passage for a cooling airflow as discussed below.

In further accordance with the embodiment shown, cooking appliance 2' includes a blower assembly 140. In a manner corresponding to that described above, blower assembly 140 includes a motor 142 supported within an opening 143 in bottom wall 6' by a bracket 144. As shown, bracket 144 includes a plurality of supports or legs 146–148 that are fastened about opening 143. As shown, blower assembly 140 includes a fan 150 that is operatively connected to motor 142 through a shaft 153. In a manner analogous to that set forth above, operation of blower assembly 140 generates a cooling airflow that is drawn into chassis 16' through a plurality of openings, such as indicated at 158 and 159 in side walls 10' and 11' respectively. In addition, given the particular orientation of control box 124, only a single elongated opening 158 is required in side wall 10' to permit an airflow to enter housing 128 and pass over the electronics (not shown) contained therein. As with the first embodiment described, a first portion of the cooling airflow is directed directly into chassis 16', while a second portion of the cooling airflow is first directed into housing 128 and then into chassis 16' to ensure proper cooling of the electronics and other components.

Figure 4:
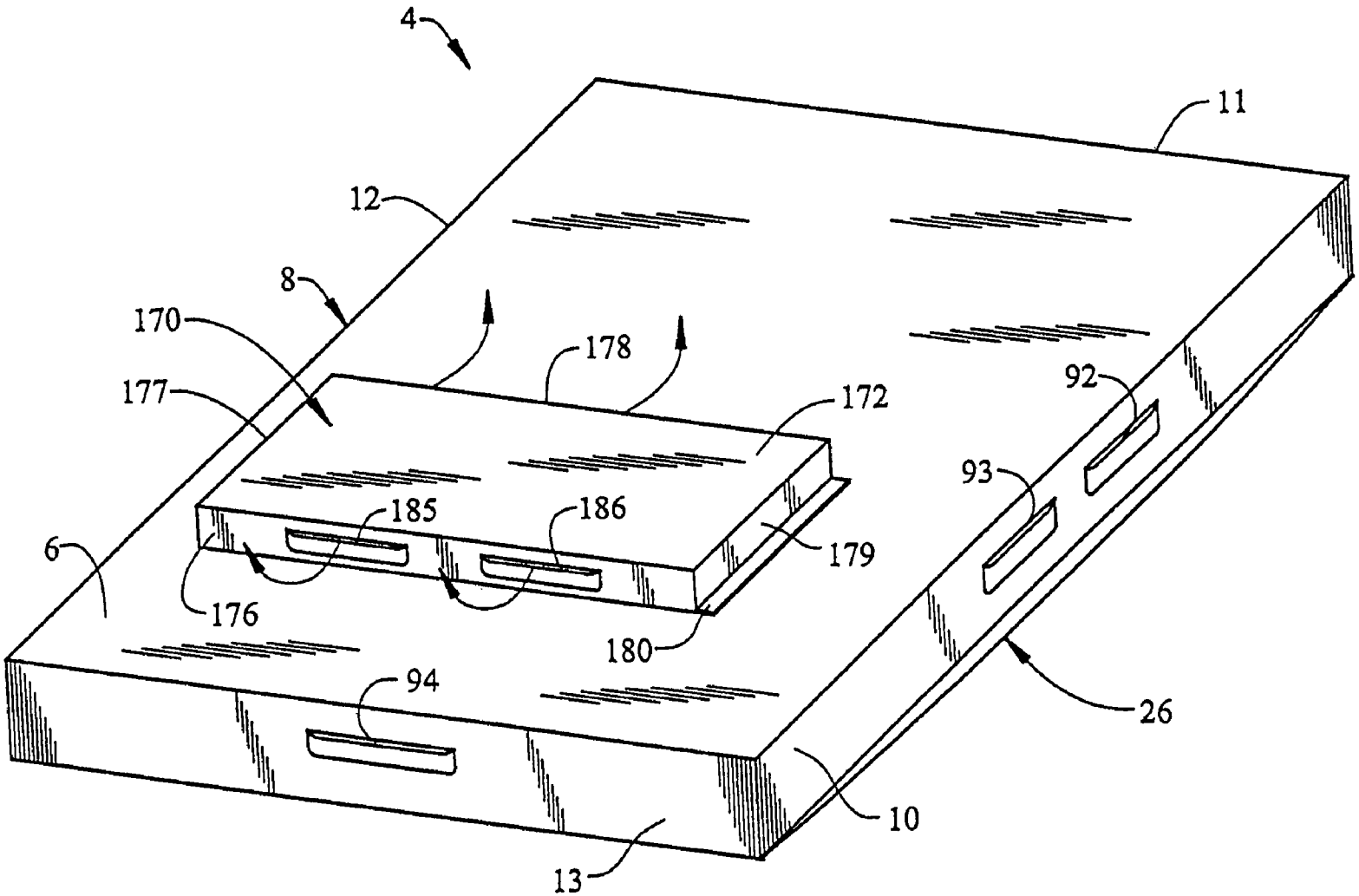
FIG. 4 is a bottom, perspective view of the cooktop of FIG. 1 illustrating an exhaust portion for the ventilation system.

In accordance with another aspect of the invention, it is desirable to properly guide and disperse the airflow exhausted from either chassis 16 or 16'. That is, as the airflow removes heat from the electronics and other components within chassis 16, the airflow must be exhausted in such a way so as to prevent heat build-up below cooking appliance 2. To this end, FIG. 4 illustrates, with reference to the structure of the first described embodiment, a preferred arrangement for guiding and dispersing the airflow that passes out of chassis 16 through opening 71. Toward that end, arranged on bottom wall 6 of frame 4 is an airflow guide and dispersion housing or cover 170. Cover 170 is positioned over opening 71 and includes a base wall 172 and a plurality of side walls 176–179 that are joined to bottom wall 6 through opposing flanges, one of which is indicated at 180. As shown, side wall 176 is provided with a plurality of openings 185 and 186 that enable the airflow to be expelled from chassis 16. Although not shown, corresponding openings are provided in at least opposing side wall 178 to further aid in dispersing the heated airflow.

As indicated above, the overall ventilation system of the present invention advantageously eliminates the need for providing an opening above or along the cooktop to allow air to pass beneath the cooktop for cooling purposes. That is, by providing openings in the side walls of the frame, space on the cooking surface can be conserved and used for other advantageous features of the appliance such as, for example, additional cooking zones, a downdraft fan unit or the like. Although described with reference to preferred embodiments of the present invention, it should be readily apparent to one of ordinary skill in the art that various changes and/or modifications can be made to the invention without departing from the spirit thereof. For instance, the particular location of the blower assembly can be varied depending upon the configuration of the heating elements. In addition, while shown in connection with a cooking appliance operating on electricity, the present invention could also be incorporated into a gas appliance, including a gas-under-glass cooktop unit. In general, the invention is only intended to be limited by the scope of the following claims.

We claim:

1. A cooking appliance comprising:

a frame including a bottom wall and a peripheral side wall extending from and about an outer periphery of the bottom wall so as to define a chassis for the cooking appliance;

a cooktop arranged atop the chassis;

a plurality of openings formed in the peripheral side wall to allow passage of air into the chassis;

a control box mounted within the chassis directly adjacent to one of the plurality of openings, said control box including a plurality of side walls that define a housing for electrical components, at least one of said side walls including a vent which opens into the chassis; and a blower assembly mounted to the chassis for providing a cooling airflow to both the control box and the chassis, wherein activation of the blower assembly functions to draw air into the chassis through the plurality of openings in the peripheral side wall, with a portion of the air passing through the control box, prior to entering the chassis.

2. The cooking appliance according to claim 1, wherein the cooktop includes an upper cooking surface including a plurality of cooking zones, as well as a plurality of control elements for selectively controlling corresponding ones of the cooking zones.

3. The cooking appliance according to claim 1, wherein the bottom wall includes an outlet opening leading out from the chassis, said blower assembly being arranged at the outlet opening.

4. The cooking appliance according to claim 3, further comprising: an airflow guide and dispersion cover positioned across the outlet opening below the chassis, said airflow guide and dispersion cover including a plurality of vents for expelling air from the chassis.

5. The cooking appliance according to claim 1, wherein the blower assembly is arranged in a corner portion of the chassis.

6. The cooking appliance according to claim 1, wherein the peripheral side wall includes multiple openings leading into the control box.

7. The cooking appliance according to claim 1, further comprising: a plurality of mounting elements arranged about the bottom wall for retaining heating elements in the chassis.

8. The cooking appliance according to claim 7, further comprising: a thermostat secured at each of the plurality of mounting elements.

9. A cooking appliance comprising:

a frame including a bottom wall and a peripheral side wall extending from and about an outer periphery of the bottom wall so as to define a chassis for the cooking appliance;

a cooktop arranged atop the chassis;

a plurality of openings formed in the peripheral side wall to allow passage of air into the chassis;

a control box mounted within the chassis directly adjacent to one of the plurality of openings, said control box including a plurality of side walls tat define a housing for electrical components, at least one of said side walls including a vent which opens into the chassis; and means for cooling both the control box and the chassis by drawing air into the chassis through the plurality of openings in the peripheral side wall, with a portion of the air passing through the control box, prior to entering the chassis.

10. The cooking appliance according to claim 9, wherein the cooktop includes an upper cooking surface including a plurality of cooking zones, as well as a plurality of control elements for selectively controlling corresponding ones of the cooking zones.

11. The cooking appliance according to claim 9, wherein the bottom wall includes an outlet opening leading out from the chassis, said cooling means including a blower assembly arranged at the outlet opening.

12. The cooking appliance according to claim 11, further comprising: an airflow guide and dispersion cover positioned across the outlet opening below the chassis, said airflow guide and dispersion cover including a plurality of vents for expelling air from the chassis.

13. The cooking appliance according to claim 9, wherein the cooling means is arranged in a corner portion of the chassis.

14. The cooking appliance according to claim 9, wherein the peripheral side wall includes multiple openings leading into the control box.

15. The cooking appliance according to claim 9, further comprising: a plurality of mounting elements arranged about the bottom wall for retaining heating elements in the chassis.

16. The cooking appliance according to claim 15, further comprising: a thermostat secured at each of the plurality of mounting elements.

17. The cooking appliance according to claim 9, wherein the cooling means is constituted by an electrical fan supported by the chassis through a bracket.

18. The cooking appliance according to claim 17, wherein the bracket includes a plurality of support legs projecting within the chassis.

19. A method of cooling components mounted in a frame including a bottom wall and a peripheral side wall that collectively define a chassis upon which is mounted a cooktop of a cooking appliance comprising:

activating a blower assembly mounted to the chassis to create an airflow;

drawing a first portion of the airflow directly into the chassis through a plurality of openings formed in the peripheral side wall;

drawing in a second portion of the airflow through openings extending through the peripheral side wall, with said second portion of the airflow initially passing into an electronic component control box mounted in the chassis and then being directed into the chassis through vents provided on side walls of the control box; and exhausting the first and second portions of the airflow through the bottom wall of the chassis.

20. The method of claim 19, further comprising: exhausting the first and second portions of the airflow through an airflow guide and dispersion cover mounted beneath the bottom wall of the chassis.

* * * * *